US012103070B2

(12) United States Patent
Heinrich et al.

(10) Patent No.: US 12,103,070 B2
(45) Date of Patent: Oct. 1, 2024

(54) SLIDE GATE ON THE SPOUT OF A METALLURGICAL VESSEL

(71) Applicant: Refractory Intellectual Property GmbH & Co. KG, Vienna (AT)

(72) Inventors: Beat Heinrich, Zurich (CH); Jean-Daniel Cousin, Lucerne (CH)

(73) Assignee: Refractory Intellectual Property GmbH & Co. KG, Vienna (AT)

( * ) Notice: Subject to any disclaimer, the term of this patent is extended or adjusted under 35 U.S.C. 154(b) by 0 days.

(21) Appl. No.: 18/005,677

(22) PCT Filed: Jun. 4, 2021

(86) PCT No.: PCT/EP2021/065008
§ 371 (c)(1),
(2) Date: Jan. 17, 2023

(87) PCT Pub. No.: WO2022/017673
PCT Pub. Date: Jan. 27, 2022

(65) Prior Publication Data

US 2023/0278096 A1 Sep. 7, 2023

(30) Foreign Application Priority Data

Jul. 21, 2020 (EP) ..... 20186977

(51) Int. Cl.
*B22D 41/24* (2006.01)
*B22D 41/34* (2006.01)
(Continued)

(52) U.S. Cl.
CPC ..... *B22D 41/24* (2013.01); *B22D 41/34* (2013.01); *B22D 41/38* (2013.01); *B22D 41/40* (2013.01)

(58) Field of Classification Search
CPC ..... B22D 41/24; B22D 41/34; B22D 41/38; B22D 41/40
See application file for complete search history.

(56) References Cited

U.S. PATENT DOCUMENTS

RE27,237 E * 11/1971 Shapland ..... C21C 7/0081 222/600
3,779,424 A 12/1973 Shapland, Jr.
(Continued)

FOREIGN PATENT DOCUMENTS

EP 0187899 A2 7/1986
EP 0891829 A1 1/1999
(Continued)

*Primary Examiner* — Kevin E Yoon
(74) *Attorney, Agent, or Firm* — Brian Roffe

(57) ABSTRACT

A sliding closure (10) at the outlet of a metallurgic container is provided with a housing (12), at least one closing plate arranged therein, a longitudinally displaceable closing plate and a cover (15), fastened to the housing (12) by means of a bracing mechanism (20). The closing plates can be pressed against one another by the bracing mechanism (20) via the cover (15). The bracing mechanism (20) having at least one spring member (33) is provided with clamping levers (21, 22) pivotably housed on either side at the housing (12) and supports (23, 24) which cooperate with same, with the result that, by pivoting these clamping levers (21, 22), the cover (15) can be fastened to, or released from, the housing. In this way, the closing plates, which often need to be exchanged, can also be braced, always uniformly and optimally, against one another, even after many operational uses.

20 Claims, 2 Drawing Sheets

(51) Int. Cl.
*B22D 41/38* (2006.01)
*B22D 41/40* (2006.01)

(56) References Cited

U.S. PATENT DOCUMENTS

| | | | | | |
|---|---|---|---|---|---|
| 4,077,552 | A * | 3/1978 | Lothmann | ..... | B22D 41/40 222/600 |
| 4,728,014 | A | 3/1988 | Keller | | |
| 5,695,674 | A | 12/1997 | Szadkowski | | |
| 5,961,873 | A | 10/1999 | Keller | | |
| 9,266,169 | B2 | 2/2016 | Steiner et al. | | |
| 9,884,366 | B2 | 2/2018 | Steiner et al. | | |
| 2012/0119486 | A1 | 5/2012 | Steiner et al. | | |
| 2013/0299119 | A1 | 11/2013 | Heller et al. | | |
| 2015/0246392 | A1 | 9/2015 | Gisler et al. | | |
| 2018/0009028 | A1 | 1/2018 | Cousin et al. | | |
| 2021/0268581 | A1 | 9/2021 | Heinrich et al. | | |
| 2021/0339311 | A1 | 11/2021 | Heinrich et al. | | |

FOREIGN PATENT DOCUMENTS

| | | | | | |
|---|---|---|---|---|---|
| EP | 2670546 | B1 | 2/2017 | | |
| GB | 2099966 | A | 12/1982 | | |
| WO | WO-2009139471 | A1 * | 11/2009 | ..... | B22D 41/24 |
| WO | 2022017673 | A1 | 1/2022 | | |

* cited by examiner

SLIDE GATE ON THE SPOUT OF A METALLURGICAL VESSEL

FIELD OF THE INVENTION

The invention relates to a sliding closure at the outlet of a metallurgic container, with a housing, a closing plate arranged therein, at least one longitudinally displaceable closing plate and with a cover which can be fastened to the housing by means of a bracing mechanism, wherein the closing plates can be pressed against one another by the bracing mechanism via the cover, this according to the preamble of claim 1.

BACKGROUND OF THE INVENTION

A known sliding closure according to document EP-A-0 891 829 has a housing which can be fastened to the container, in which is accommodated a fire-proof closing plate stationary at the top and bottom, as well as a fire-proof slide plate which can be moved forwards and backwards between these by a power unit. The stationary closing plates are fixed in a cover or in the housing, whereas the slide plate is fastened in a metal frame coupled to the power unit. The cover is fastened to the housing in releasable manner by clamping screws and blocked by blocking means in displacement direction of the slide plate which can move forwards and backwards, meanwhile an adjustment of same, occurring perpendicular to the displacement direction, is made possible.

In a different embodiment, with a sliding closure with a casting tube changing device, the cover arranged on the top side of the housing is pivotably housed on this housing, and clamping screws which can pivot on the housing are attached to same to press together the closing plates. However, these clamping screws have to be fastened or released individually, and care must be taken that they are tightened with a specific torque to function faultlessly.

OBJECTS AND SUMMARY OF THE INVENTION

The object of the invention is to develop a sliding closure of the type named at the outset, such that the cover can be closed simply or opened at or by the housing to change the closing plates, and in so doing, an optimal bracing of the closing plates and furthermore a tight enclosing of same is guaranteed by the housing and by the cover during operation.

The object is achieved according to the invention according to the feature of claim 1.

This bracing mechanism, by means of which the cover can be braced to the housing, has, according to the invention, clamping levers pivotably housed on either side of the housing, and supports which cooperate with same, with contact surfaces which are associated either with the housing or the cover.

In this way, by this bracing mechanism according to the invention, the closing plates can always be braced against one another uniformly and optimally, even after many operational uses.

Very advantageously, two clamping levers are pivotably housed on either side of the housing or cover, wherein they are each arranged pivotable against one another or away from one another on both sides. This allows for a uniform bracing of the closing plates.

The bracing mechanism has an adjusting member for the respective actuation of the clamping levers, which member is arranged laterally displaceable in longitudinal direction transverse to the bracing direction of the closing plates, wherein the member is connected to the one clamping lever in articulated manner at one end and to a preferably manually rotatable axis for actuating same at the other end.

BRIEF DESCRIPTION OF THE DRAWINGS

The invention, as well as further advantages of same, are explained in more detail below using embodiment examples, with reference to the drawings. There are shown in.

DETAILED DESCRIPTION OF THE INVENTION

Figure 1:
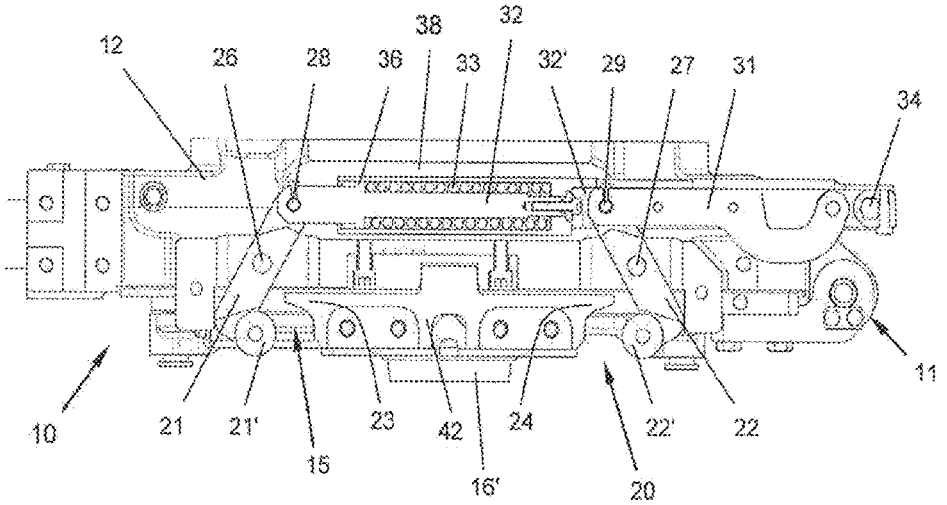
FIG. 1 is a side view of the sliding closure with the bracing mechanism according to the invention in opened state, in partial section.
Figure 2:
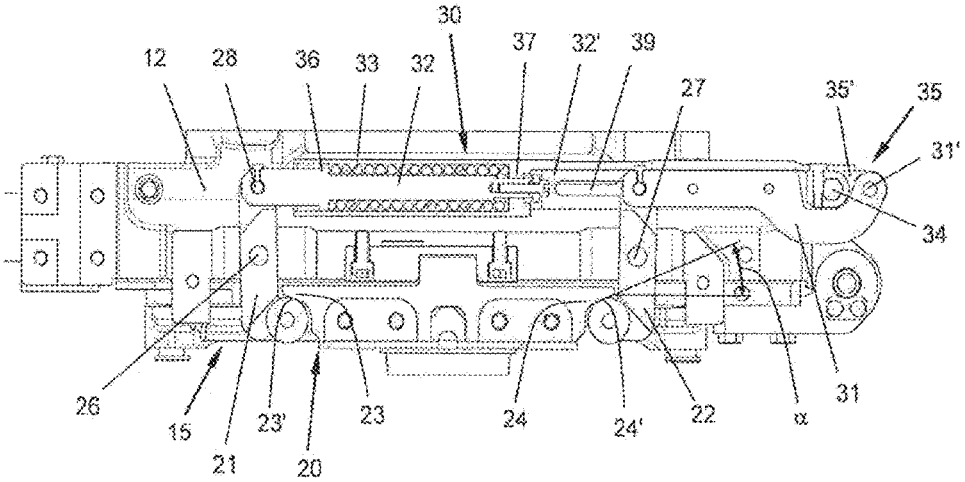
FIG. 2 is a side view of the sliding closure according to FIG. 1 with the bracing mechanism in closed state, in partial section.
Figure 3:
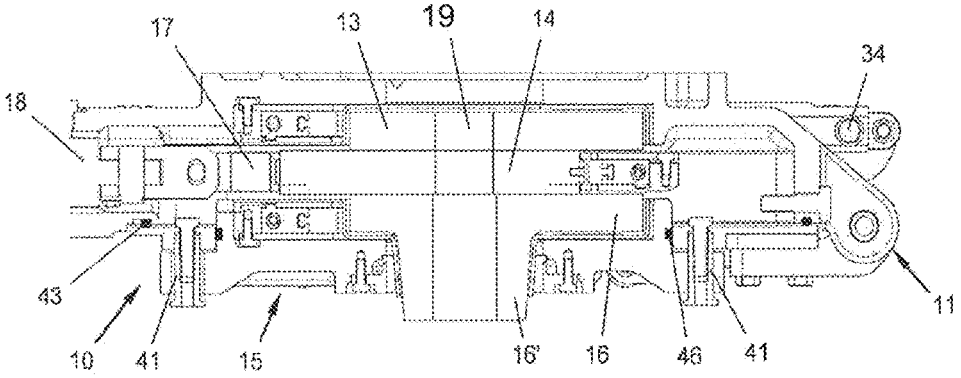
FIG. 3 is a longitudinal section of the sliding closure according to FIG. 1 with a closing plate fixed at the top or bottom, and mobile in the center.

FIG. 1 to FIG. 3 show a sliding closure 10 which can be mounted on the outlet of a metallurgic container, which can be in particular a distribution vessel or the like in a strand casting system for producing steel strands, not shown in more detail. In principle, the sliding closure could be used in other ways, such as for example in furnaces in the non-ferrous field for controlled casting of copper or the like.

According to FIG. 3, sliding closure 10 is provided with a housing 12 and a cover 15 articulated thereto by a hinge 11. In these, there are arranged an upper and lower fire-proof closing plate 13, 16 as well as a longitudinally displaceable closing plate 14 arranged therebetween. The longitudinally displaceable closing plate 14 is clamped into a plate frame 17 and can be moved into an opening or closing position by a power unit 18, not shown in more detail, while corresponding throughflow openings 19 are provided on the closing plates 13, 14, 16. An inner fire-proof sleeve, not shown but embedded in the container, is conventionally connected to upper closing plate 13. Lower closing plate [16'] 16 is elongated by a sleeve-shaped projection 16'. A fire-proof casting tube or ladle shroud or the like can be pressed thereon, in order to make possible sealed casting.

Closing plates 13, 14, 16 are clamped in housing 12 or in cover 15 in routine manner, as is explained at length in patent specification EP 2 670 546 B1.

Cover 15 is fastened to housing 12 by means of a bracing mechanism 20 and, in so doing, closing plates 13, 14, 16 are pressed against one another via cover 15, in order to ensure leak tightness between these.

According to the invention, bracing mechanism 20 has, preferably on both sides of the housing 12, two opposing pivotably housed clamping levers 21, 22 and supports 23, 24 cooperating with same, wherein clamping levers 21, 22 are each pivotably housed in their central region on axes of rotation 26, 27 laterally at the housing 12, while supports 23, 24 are attached laterally to cover 15.

Clamping levers 21, 22 are housed in articulated manner on one end by means of an axis 28, 29 each on an adjusting member 30 which can be actuated by an axis 34, and equipped with a sliding element 21', 22' which grips the support 23, 24 at the other end, with the result that they grip the supports upon bracing, and can be pivoted away from same when released.

Very advantageously, two clamping levers 21, 22 are arranged symmetrical to one another on either side of housing 12, each with an adjusting member 30. This axis 34 extends approximately over the width of housing 12 and is coupled to adjusting member 30 on both sides of housing 12, with the result that, when this axis 34 is rotated, for example by means of a removable spanner, clamping levers 21, 22 move in the same direction simultaneously on either side of housing 12 and engage in supports 23, 24 or are released from same.

Advantageously, adjusting member 30 and clamping levers 21, 22 are arranged on the two opposing sides of box-shaped housing 12, running parallel to the displacement direction of longitudinally displaceable closing plate 14, whereas hinge 11 and power unit 18 are positioned on the narrow, transverse sides. Additionally, when braced, clamping levers 21, 22 are oriented with their longitudinal extension in bracing direction of sliding closure 10, as can be seen in FIG. 2, in order that only slight bending moments occur thereon.

Expediently, sloping contact surfaces 23', 24' are arranged at each of supports 23, 24 such that, when braced, clamping levers 21, 22 each engage approximately in their center, in order that, depending on the extent and tolerances of closing plates 13, 14, 16 and the mechanism, they can be adjusted in their operating state in one or other direction on these contact surfaces 23', 24'.

Each of the contact surfaces 23', 24' of supports 23, 24 is provided with a gradient angle $\alpha$ from 0 to 40°, for example 20°, with the result that sliding elements 21', 22', such as rollers or hooks, run in bracing direction of the closing plates in the closing process. The frictional force between sliding elements 21', 22' and supports 23, 24 changes depending on the gradient angle $\alpha$. In practice, it has been shown that the best strength or friction ratios are produced with a gradient angle $\alpha$ of more than 0°, preferably 10 to 45°.

Adjusting member 30 of bracing mechanism 20 provided for actuating the two clamping levers 21, 22 extends laterally in the housing 12 transverse to the bracing direction or along the closing plates. It consists of a longitudinal guide element 32 with an integrated spring member 33 and a pivot lever 31 guided longitudinally from same. Guide element 32 is rotationally connected to one clamping lever 21 at one end via this axis 28 and to preferably manually rotatable axis 34 at the other end, outside of the housing 12. On one hand, the guide element 32 comprises a rod with the linkage of the clamping lever 21 and on the other hand, a rail 32' with the receiver of axis 34 and a guide groove 39 for axis 29 of pivot lever 31 at the clamping lever 22. Spring member 33, e.g., a helical spring, designed as compression spring, is pushed up on the rod, which member is stabilized on a stop 36 in the rod and on a piston member 37 which can be displaced in limited manner against same. Furthermore, this rod and the spring member 33 are housed in a protective channel 38 in housing 12.

Axis 34, housed in the end of rail 32', is also rotationally connected to pivot lever 31 by a toggle lever joint 35. There are housed by this a lever 35' on one side on axis 34, and on the other side, on a bolt 31' at the end of pivot lever 31. The latter is bent to be U-shaped, whereby it strikes against axis 34, as illustrated in FIG. 2. This is measured such that toggle lever joint 35 pivots outwards via the dead center and thus a locking takes place automatically in the fastened state of cover 15.

To close or open cover 15, axis 34 is moved or pivoted, manually or by a rotary drive (not visible), and with it, adjusting member 30 is moved or pivoted with clamping levers 21, 22 from the position according to FIG. 1 into that according to FIG. 2 or vice versa. During bracing, pivot lever 31 is pivoted about axis 34 by toggle lever joint 35 and simultaneously connected clamping lever 22 is pressed about axis 27 against this support 24 of folded cover 15. In so doing, pivot lever 31 is guided, longitudinally, with its axis 29 into this guide groove 39 of rail 32'.

During pivoting, also simultaneously, guide element 32 is pushed into housing 12 and axis 34 also moves with it in the same direction. Accordingly, the other, opposite clamping lever 21 is pressed about axis 26 against the other support 23 of folded cover 15. When the rod is pushed, spring member 33 is quasi pushed by piston member 37 against stop 36, causing a spring compressive force against clamping levers 21, 22 and thus a bracing force on the covers and closing plates. Toggle lever joint 35 acts on the opposite side of adjusting member 30 and with same the pivot lever 31, and locking takes place due to pivoting about the dead center, in which the bolt 31' comes to lie behind the longitudinal axis of guide element 32 in bracing direction.

Figure 4:
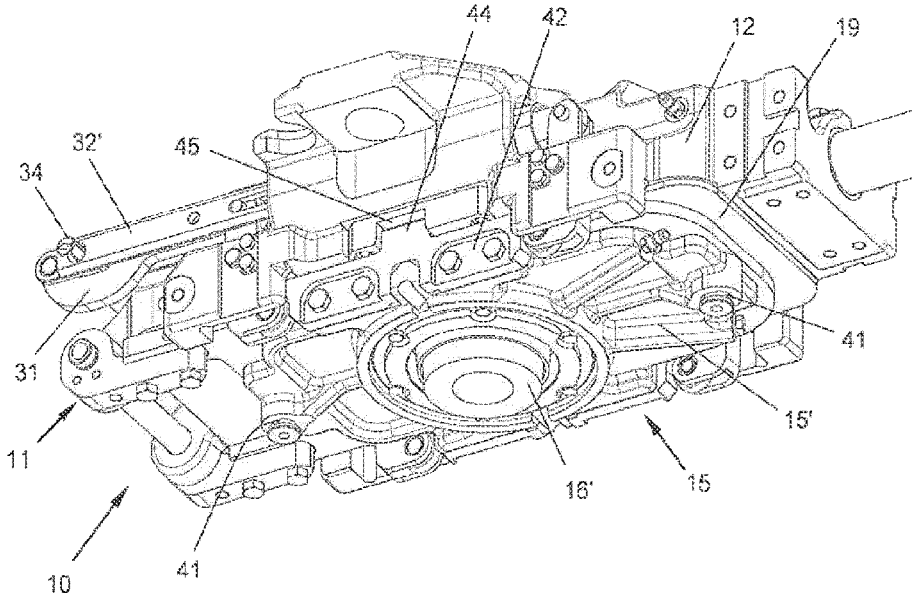
FIG. 4 is a view from below of the cover of the sliding closure according to FIG. 1.

According to FIG. 4, cover 15 is composed of a cover frame 19 articulated on housing 12 by means of hinge 11 and a closing cap 15' which can be placed thereupon. Supports 23, 24 cooperating with clamping levers 21, 22 of a plate 42 are fastened to the outside of closing cover 15'. Preferably a plurality of non-obvious springs and guide means 41 are arranged between this closing cover 15' and cover frame 19, which make it possible, in pressing direction of the closing plates, for closing cover 15' to be able to be displaced against cover frame 19 and housing 12 in limited manner.

Thermal expansions or depletion and tolerances of the fire-proof closing plates and/or of the housing or the mechanism can thus be compensated for overall, with the result that an approximately equal compressive force is always enacted. With the springs it is additionally ensured that, at any time, cover frame 19 presses with approximately equal force on a rope seal 43, 46 integrated in housing 12, which seal seals all around between housing 12 and cover frame 19. Regardless of the fitting or relative cover position, this rope seal 43 is thus constantly under strain, and therefore also not overstressed. Furthermore, a rope seal 46 is advantageously introduced, likewise all around between cover frame 19 and closing cover 15.

This plate 42 with supports 23, 24 on each of the outer sides of closing cover 15 is furthermore additionally provided with a centering element 44, which engages laterally, approximately play-free, in a recess 45 at housing 12, in order that cover 15 connected to plate 42 is fixed in displacement direction of central closing plate 14.

The invention is sufficiently disclosed using the above embodiment examples. However, self-evidently, it could also be carried out using further variants.

As with a conventional slide gate closure, it may also contain only two closing plates. The movable closing plate would be advantageously integrated inside a slider unit which can be pushed in and out by a power unit.

With the bracing mechanism, in principle only one pivotably housed clamping lever, needing to be oriented against one another, could be provided on either side of the housing.

This bracing mechanism could also be attached to the sliding closure rotated about 180°, i.e., the adjusting member would then be attached to the cover and the supports to the housing, analogously. Instead of on the housing, the clamping levers would alternatively be pivotably housed on the cover, wherein they could pivot against one another with each sliding element at the end and simultaneously would engage with a contact surface of the support vice versa on the housing.

Contact surfaces 23', 24' each running slopingly on support 23, 24 could also be designed as rollers or the like. Preferably, the sliding elements of the clamping levers would then be provided as hooks with a flat bearing. This gradient angle (a) could theoretically also be measured at 0°, with the result that the sliding elements would run transverse to the bracing direction of the closing plates during the closing process.

In principle, such a bracing mechanism with an adjusting member 30 and two clamping levers could be provided also only on one side of the housing, whereas on the other side, a hinge for pivoting the cover would be provided on the housing.

The invention claimed is:

1. A sliding closure at an outlet of a metallurgical container, comprising:

a housing, a closing plate arranged in the housing, a longitudinally displaceable closing plate, a cover, and a bracing mechanism that fastens the cover to the housing, wherein the bracing mechanism is configured to push the closing plate and the longitudinally displaceable closing plate against one another via the cover, the bracing mechanism including, on each side of the housing, at least one spring member extending in a direction in which the longitudinally displaceable closing plate is displaceable, pivotable clamping levers and with supports cooperating with the clamping levers, whereby the cover is fastened to or released from the housing by pivoting the clamping levers.

2. The sliding closure according to claim 1, wherein the bracing mechanism further comprises actuatable adjusting members one on each side of the housing, the clamping levers are each housed in their central region in an articulated manner at one end at a respective one of the actuatable adjusting members and are provided, at the other end, with a sliding element that engages with a respective one of the supports such that, when bracing, the clamping levers grip around the supports and are pivotable away from the supports when being released.

3. The sliding closure according to claim 2, wherein each of the actuatable adjusting members provided for actuating the clamping levers is arranged transverse to a bracing direction of the closing plate and the longitudinally displaceable closing plate laterally at the housing in a longitudinal direction, wherein at one end, each of the actuatable adjusting members is connected in an articulated manner to a respective one of the clamping levers and at the other end to a manually rotatable axis to enable actuation.

4. The sliding closure according to claim 3, wherein each of the actuatable adjusting members comprises a longitudinal guide element with the at least one spring member being an integrated spring member and a pivot lever guided longitudinally from the integrated spring member with a toggle lever joint, wherein the longitudinal guide element is rotationally connected to one of the clamping levers at one end and to the axis at the other end, and wherein the pivot lever is rotationally connected to the other one of the clamping levers at one end and to the axis by the toggle lever joint at the other end.

5. The sliding closure according to claim 4, wherein the toggle lever joint moving around the axis at the end and striking the axis is configured to pivot about its dead center and thus a locking takes place automatically in a fastened state of the cover.

6. The sliding closure according to claim 5, wherein each respective integrated spring member is stabilized in the respective longitudinal guide element such that, when the cover is braced to the housing, the cover produces a compressive force on the clamping levers in a closing direction.

7. The sliding closure according to claim 6, wherein the integrated spring member comprises a compression spring pushed up on a rod of the guide element, the integrated spring member being stabilized on a stop in the rod and on a piston member having a limited displacement against the rod.

8. The sliding closure according to claim 7, wherein the housing includes a protective channel in which the rod and the spring member are housed.

9. The sliding closure according to claim 1, wherein two clamping levers are pivotably housed on each side of the housing or the cover, wherein the clamping levers grip, pivotably, on both sides in each case in pairs against one another or away from one another, and simultaneously vice versa either on the cover or on the housing with a contact surface of the supports, thus causing the cover to be fastened to or released from the housing.

10. The sliding closure according to claim 1, wherein contact surfaces of each of the supports are provided with a gradient angle (a) from 0 to 40°, such that sliding elements of the clamping levers run slopingly in a bracing direction of the closing plate and the longitudinally displaceable closing plate in a closing process.

11. The sliding closure according to claim 10, wherein the sliding elements comprise rollers.

12. The sliding closure according to claim 10, wherein the sliding elements comprise hooks.

13. The sliding closure according to claim 1, wherein the closing plate is stationary in the housing and provided in a frame that is longitudinally displaceable by a power unit and the sliding closure further comprises an additional closing plate fixed in the cover.

14. The sliding closure according to claim 1, wherein the cover comprises a cover frame articulated on the housing and a closing cover which is placed on the closing frame, wherein the supports cooperate with the clamping levers that are fastened to an outside of the closing cover.

15. The sliding closure according to claim 14, further comprising a plurality of springs and guide means arranged between the closing cover and the cover frame, the plurality of springs and guide means enabling, in a compressing direction of the closing plate and the longitudinally displaceable closing plate, the closing cover to be able to be shifted opposite the cover frame and the housing to a limited extent, and thus thermal expansions, depletion, tolerances of the closing plate and the longitudinally displaceable closing plate and/or of the housing or the mechanism can be compensated for, such that there is also an approximately equal compressive force.

16. The sliding closure according to claim 14, wherein each of the supports is attached to a plate on an outside of the closing cover, wherein the plate is additionally provided with a centering element which engages laterally in a recess on the housing, such that the cover connected to the plate is fixed in the displacement direction of the longitudinally displaceable closing plate.

17. The sliding closure according to claim 14, further comprising a rope seal integrated in each of the housing and the cover, each rope sealing all around between the housing and the cover frame or between the cover frame and the cover.

18. The sliding closure according to claim 14, further comprising:

a plurality of springs and guide means arranged between the closing cover and the cover frame, the plurality of springs and guide means enabling, in a compressing direction of the closing plate and the longitudinally displaceable closing plate, the closing cover to be able to be shifted opposite the cover frame and the housing.

19. The sliding closure according to claim 14, wherein each of the supports is attached to a plate on an outside of the closing cover, wherein the plate is provided with a centering element which engages laterally, approximately play-free, in a recess on the housing, such that the cover connected to the plate is fixed in a displacement direction of the longitudinally displaceable closing plate.

20. The sliding closure according to claim 1, wherein the clamping levers are pivotably housed.

* * * * *